US010323456B2

(12) United States Patent
Lin

(10) Patent No.: US 10,323,456 B2
(45) Date of Patent: Jun. 18, 2019

(54) AWNING ADJUSTMENT DEVICE WITH VARIABLE SPEED AND DIRECTION CONTROL

(71) Applicant: Airflex 5D, LLC, Garden Grove, CA (US)

(72) Inventor: Wendy Lin, Chino Hills, CA (US)

( * ) Notice: Subject to any disclaimer, the term of this patent is extended or adjusted under 35 U.S.C. 154(b) by 242 days.

(21) Appl. No.: 15/619,419

(22) Filed: Jun. 9, 2017

(65) Prior Publication Data

US 2018/0355666 A1 Dec. 13, 2018

(51) Int. Cl.

| | |
|---|---|
| ***E04F 10/06*** | (2006.01) |
| ***E06B 9/68*** | (2006.01) |
| ***E06B 9/76*** | (2006.01) |
| *E04H 15/58* | (2006.01) |

(52) U.S. Cl.

CPC ..... *E06B 9/76* (2013.01); *E04F 10/0644* (2013.01); *E04F 10/0659* (2013.01); *E06B 9/68* (2013.01); *E04H 15/58* (2013.01)

(58) Field of Classification Search

CPC .. E04H 15/58; E04F 10/0659; E04F 10/0644; E06B 9/68; E06B 9/76

See application file for complete search history.

(56) References Cited

U.S. PATENT DOCUMENTS 4,724,882 A * 2/1988 Wang ..... E04F 10/0614 135/117
2001/0027846 A1* 10/2001 Osinga ..... E04F 10/0659 160/70
2004/0169490 A1* 9/2004 Heurtault ..... E04F 10/0648 320/114
2011/0048651 A1* 3/2011 Goth ..... E04F 10/0614 160/22
2014/0216669 A1* 8/2014 George ..... E06B 9/76 160/405

FOREIGN PATENT DOCUMENTS

| | | | | |
|---|---|---|---|---|
| DE | 1977977 U | * | 2/1968 | ..... E06B 9/70 |
| DE | 20317282 U1 | * | 4/2004 | ..... E06B 9/78 |
| DE | 202007011753 U1 | * | 10/2007 | ..... E06B 9/76 |
| DE | 202014005051 U1 | * | 8/2014 | ..... E04F 10/0648 |
| EP | 0101009 A2 | * | 2/1984 | ..... E04F 10/0648 |

(Continued)

*Primary Examiner* — David R Dunn
*Assistant Examiner* — Danielle Jackson
(74) *Attorney, Agent, or Firm* — Tommy SF Wang; Wang IP Law Group, P.C.

(57) ABSTRACT

An awning adjustment device with variable speed and direction control serves to automatically open and close eclectic types of awnings by way of an elongated rod terminating at a hook. The hook detachably couples to an awning handle or crank mechanism. A motor powers the rod, so as to rotate the rod in variable speeds, directions, and durations. The rotational speed of the rod is either controlled by a user, or controlled by a rotation counter to variably increase or decrease the rotation of the rod, so as to prevent damaging the awning by rotating too fast. The control portion comprises a power on switch, a power off switch, a pause switch, a directional switch, and a speed switch. The motor operatively couples to at least one electrical power source through a power cord, or a battery to receive electrical power for operating the device.

20 Claims, 4 Drawing Sheets

(56) References Cited

FOREIGN PATENT DOCUMENTS

| | | | | | |
|---|---|---|---|---|---|
| EP | 0286556 | A1 * | 10/1988 | ..... | E04H 15/58 |
| EP | 2314823 | A2 * | 4/2011 | ..... | E06B 9/76 |
| FR | 2960019 | A1 * | 11/2011 | ..... | E06B 9/76 |
| JP | 2002339671 | A * | 11/2002 | | |
| WO | WO-0233211 | A1 * | 4/2002 | ..... | E06B 9/76 |

* cited by examiner

AWNING ADJUSTMENT DEVICE WITH VARIABLE SPEED AND DIRECTION CONTROL

FIELD OF THE INVENTION

The present invention relates generally to an awning adjustment device with variable speed and direction control that can be operated with two hands. More so, the present invention relates to an awning manipulation device that opens and closes awnings by way of an elongated rod provided with a hook and by rotating the elongated rod such as to gradually displace the awning towards the desired position; whereby the rotational speed of the rod is either controlled by a user, or controlled by a rotation counter to variably increase or decrease the rotation of the rod, so as to prevent damaging the awning by rotating too fast; and whereby a motor operatively couples to at least one electrical power source to power the device.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, an awning is a secondary covering attached to the exterior wall of a building. It is typically composed of canvas canopy that is stretched tightly over a light structure of aluminum. Numerous types of inside and outside awnings are commercially available, including curtains on a curtain rail, optionally raisable roller blinds, pleated and cellular shades, folding blinds, vertical slat blinds, horizontal slat blinds.

Generally, retractable awnings have been utilized for many years, particularly as awnings for windows or entry doors of building structures. The awnings are typically rolled out during daylight hours to block undesired sun rays and rolled in at night when the sun has gone down. Such awnings normally include a roll bar which is mounted in a moveable manner along an outer edge of the awning sheet so as to roll away from and back to the building as the awning is extended and retracted, respectively.

It is also known that retractable awnings have been mounted on the sides of mobile homes, recreational vehicles, travel trailers or the like. These newer versions of the retractable awning normally include support posts for supporting the outer edge of the awning sheet either by forming a brace from a side wall of the vehicle or by forming a ground support.

Generally, awnings are manually opened and closed by way of an elongated rod with a hook. The rod is manually rotated such as to gradually displace the awning towards the desired position. This operation requires a considerable number of rotations of this rod. Recently, motorized systems have been developed in order to open and close awnings.

It is known in the art that retractable awnings can be rotationally manipulated to extend and retract the cover. One type of retractable awning is a retractable lateral arm awning. This is a modern version of a manual crank-up awnings, in which tension arms and a roller bar are supported by a torsion bar. The torsion bar fits into wall or soffit brackets that spread the load to the width of the wall.

Another known type of awning is a retractable side awning. Commonly used to shade a window, with a roller tube at the top, spring-loaded side arms, and a motor, crank or tape-pull operator. Yet another type of retractable awning is a pop-up canopy.

Other proposals have involved devices to manipulate awnings. The problem with these awning operational devices is that they do not automate the process. Also, the rotational speed is constant, which can cause damage to the awning; especially when extending or retracting the canopy too fast. Even though the above cited awning operation devices meets some of the needs of the market, an awning adjustment device with variable speed and direction control. More so, the present invention relates to an awning manipulation device that opens and closes awnings by way of an elongated rod provided with a hook and by rotating the elongated rod such as to gradually displace the awning towards the desired position; whereby the rotational speed of the rod is either controlled by a user, or controlled by a rotation counter to variably increase or decrease the rotation of the rod, so as to prevent damaging the awning by rotating too fast, is still desired.

SUMMARY

Illustrative embodiments of the disclosure are generally directed to an awning adjustment device with variable speed and direction control that can be operated with two hands. The awning adjustment device serves to automatically open and close eclectic types of awnings by way of an elongated rod terminating at a hook. The hook detachably couples to an awning handle or crank mechanism, known in the art.

A motor powers the rod, so as to rotate the rod in variable speeds, directions, and durations. In this manner, the canopy for an awning can be extended and retracted towards a desired position. The rotational speed of the rod is either controlled by a user, or controlled by a rotation counter to variably increase or decrease the rotation of the rod, so as to prevent damaging the awning by rotating too fast. The motor operatively couples to at least one electrical power source through a power cord, or a battery to receive electrical power for operating the device.

In one aspect, an awning adjustment device with variable speed control, comprises a handle that is defined by a sidewall forming a cavity. In some embodiments, the device further comprises a motor contained in the cavity of the housing. The motor produces variable power for performing rotational functions. A handle extension portion is adjacent and axial to the handle. The handle extension portion enables two handed manipulation of the device.

In some embodiments, the device further comprises a rod that is defined by a proximal end and a distal end. The proximal end operatively connects to the motor. The rod is operable to rotate in conjunction with the power provided by the motor. In one embodiment, a hook joins with the distal end of the rod.

In some embodiments, the device further comprises a control portion operatively connected to the motor. The control portion is operable to perform at least one of the following: actuate the motor, increase the power of the motor, decrease the power of the motor, and power off the motor. In this manner, the control portion enables at least partially controls the speed of rotation and duration of rotation by the rod.

In some embodiments, the device further comprises a counter operatively connected to the motor, or the rod, or both. The counter is operable to count the number of rotations by the rod. In this manner, the counter at least partially controls the speed of rotation and duration of rotation by the rod dependent on a predetermined number of rotations by the rod.

In some embodiments, the device further comprises a source of electrical power, such as a battery. The battery may include a rechargeable battery. In another embodiment, the device utilizes a power cord that operatively connects to the motor and to an external power source. Alternative sources of electrical power known in the art may also be used to transmit electrical power to the motor.

In another aspect, the device is an electrical hand crank.

In another aspect, the control portion comprises a power on switch.

In another aspect, the control portion comprises a power off switch.

In another aspect, the control portion comprises a pause switch.

In another aspect, the control portion comprises a directional switch.

In another aspect, the control portion comprises a speed switch.

In another aspect, the rod rotates clockwise and counter-clockwise.

In another aspect, the hook is an open hook.

In another aspect, the hook detachably couples to a mechanical crank or a handle of an awning.

In another aspect, the awning comprises a canopy, a supporting framework, and a rolling bar.

One objective of the present invention is to provide an electrical hand crank for facilitated extension and retraction of an awning canopy.

Another objective is to automate the rotation of the rod, so as to minimize manual labor while extending and retracting an awning.

Another objective is to provide a control portion that allows for multiple types of variations to the rotation of the rod, including powering off, powering on, pausing, adjusting the speed, and adjusting the duration of the rotation.

Another objective is to provide a counter that counts the number of rotations I the rod or the motor, and based on the number of rotations, allows for multiple types of variations to the rotation of the rod, including powering off, powering on, pausing, adjusting the speed, and adjusting the duration of the rotation.

Another objective is to enable two handed manipulation of the device through a handle extension portion.

Another objective is to provide an inexpensive device for manipulating an awning.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figures 1, 2, 3:
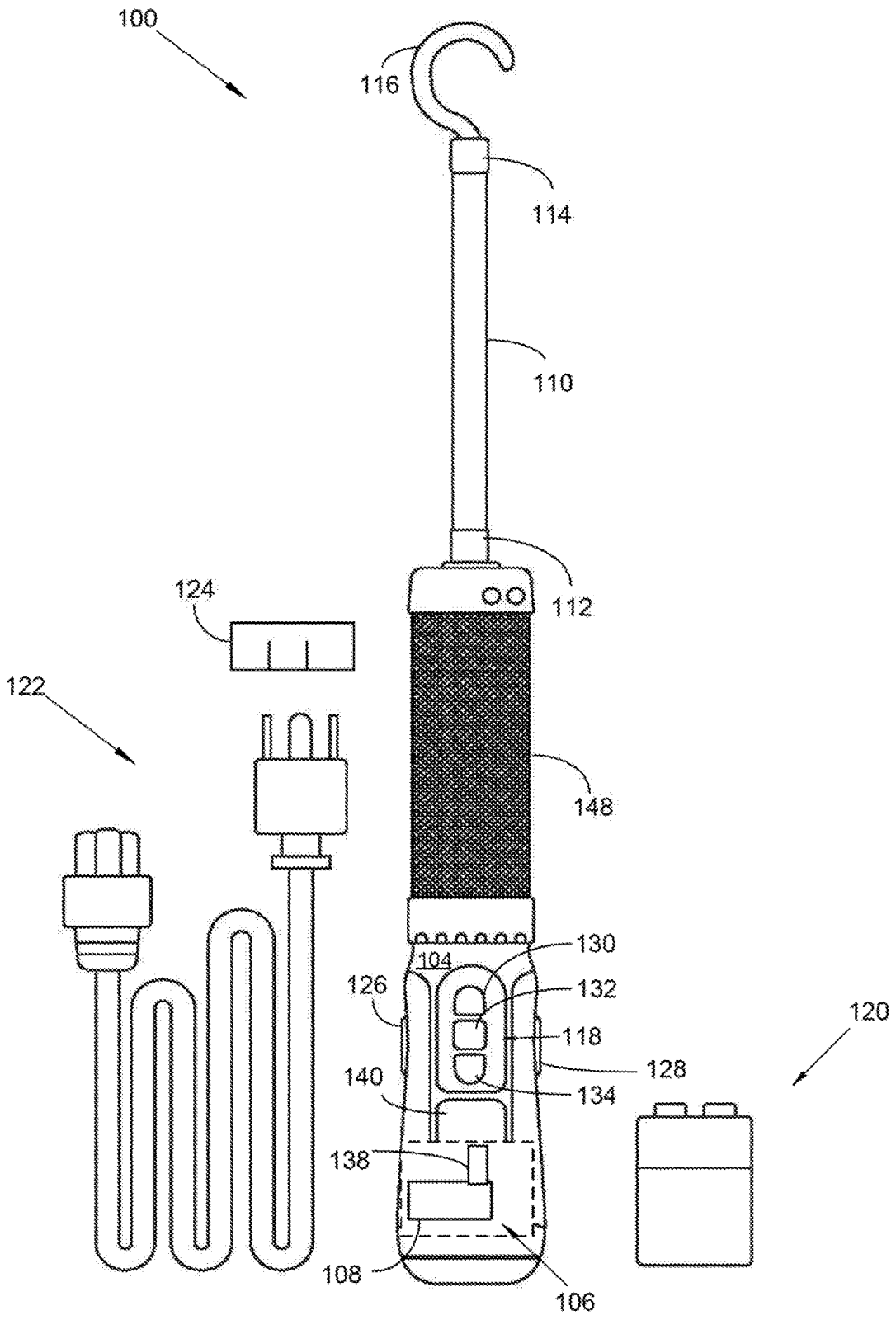
FIG. 1 illustrates a perspective view of an exemplary awning adjustment device with variable speed and direction control, detailing a sectioned view of a cavity that forms in the handle of the device, in accordance with an embodiment of the present invention.
FIG. 2 illustrates a perspective view of an exemplary external power source and power cord, in accordance with an embodiment of the present invention.
FIG. 3 illustrates a perspective view of an exemplary battery, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

An awning adjustment device 100 with variable speed and direction control is referenced in FIGS. 1-5. The awning adjustment device 100, hereafter "device 100" is a two-handed mechanism that helps a user to automatically open and close different styles, sizes, and dimensions of awnings, retractable shades, sunscreens, and blinds known in the art. One type of awning 142 that the device 100 is operable can include a canopy, a supporting framework, a mechanical crank handle, and a rolling bar.

In one possible embodiment, the device 100 is an electrical hand crank that can easily be gripped and coupled to the awning crankshaft handle, so as to displace a canopy portion 144 of an awning 142 to a desired position relative to the supporting framework of the awning 142. The device facilitates this manipulation of the canopy portion 144 by providing automated power and two-handed gripping capacity.

In some embodiments, the device 100 may be operable through use of an adjustably rotating and elongated rod 110 that terminates at a hook 116. The hook 116 detachably couples to the awning mechanical crank handle. The rod 110 is speed/direction/duration controllable through a control portion 118 and a counter 138, so as to achieve a desired rotation of the rod 110 that translates to the mechanical crank handle of the awning. In this manner, the canopy is safely and efficiently displaced to a desired position in relation to the supporting framework of the awning.

Figure 5:
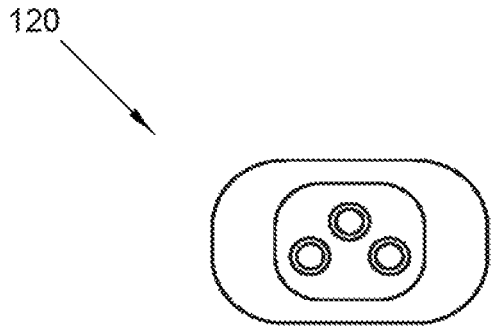
FIG. 5 illustrates a side view of the battery shown in FIG. 3, in accordance with an embodiment of the present invention.

As referenced in FIG. 1, the device 100 comprises a motor 108 that imparts rotational motion to the rod 110, so as to rotate the rod 110 in variable speeds, directions, and durations. In this manner, the awning is easily displaced towards a desired position—either extending or retracting a canopy. The rotational speed of the rod 110 is either controlled by a user through a control portion 118, or controlled by a counter 138, which variably increase or decrease the rotation of the rod 110, so as to prevent damaging the awning by rotating too fast. The motor 108 requires electrical power to operate, and therefore operatively couples to at least one electrical power source through a power cord 122 (FIG. 2), or a battery 120 (FIGS. 3 and 5).

Looking again at FIG. 1, an awning adjustment device 100 with variable speed and direction control, comprises a handle 102 for manipulation of the device 100. In one embodiment, a handle extension portion 148 that is disposed axially to the handle 102. The handle 102 and the handle extension portion 148 may be fixedly joined through a screw, a bolt, a magnet, an adhesive, or a friction fit mechanism. The handle extension portion enables the device 100 to be operated with two hands—one hand on the handle 102, and the second hand on the handle extension portion 148. The use of two hands provides greater leverage for operating the awning. Both the handle 102 and the handle extension portion 148 may be textured to provide enhanced grip.

Figures 4A, 4B, 4C:
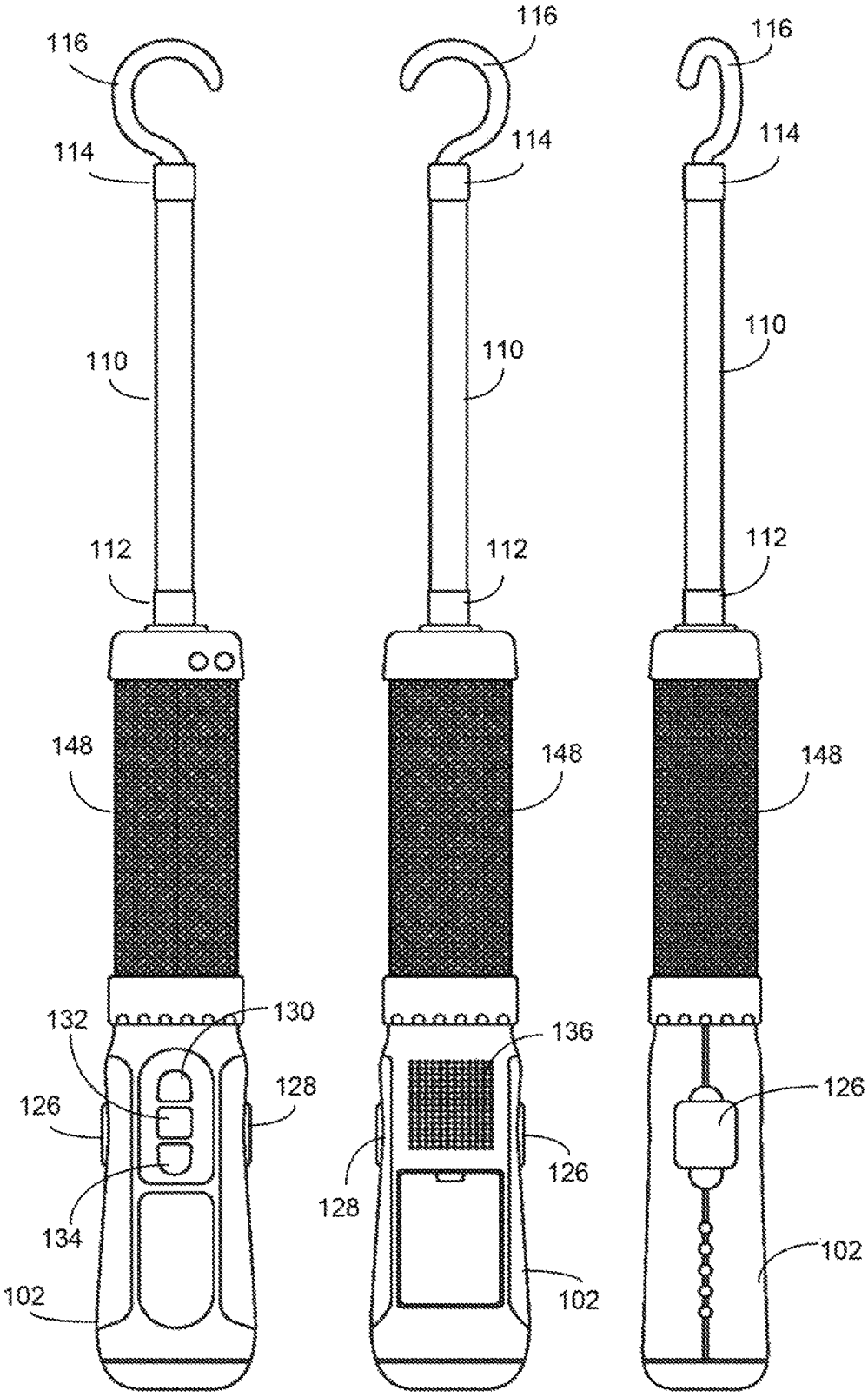
FIGS. 4A, 4B, and 4C illustrate perspective views of the awning adjustment device shown in FIG. 1, with the different views of the handle and the rod rotating clockwise, in accordance with an embodiment of the present invention.

The handle 102 is defined by a sidewall 104. The sidewall 104 is textured and forms a cavity 106. The cavity contains the electrical components of the device. In some embodiments, the handle 102 may include an elongated compartment that fits comfortably into a hand. The sidewall 104 of the handle 102 may be textured, or have a grip 136 to enhance control of the handle 102 (FIG. 4B). The cavity may be insulated to protect the wiring and circuitry of the electrical components contained therein.

In some embodiments, the device 100 further comprises a motor 108 that is contained in the cavity 106 of the handle 102. The motor 108 converts electrical power to mechanical power, and produces variable amounts of mechanical power for imparting the rotational movement to the rod 110. In one embodiment, motor 108 is a small electrical motor known in the art that can be powered by a simple electrical power source such as a battery 120, or an AC outlet. The motor 108 may include various circuits, resistors, transponders, and coils known in the art.

In some embodiments, the device 100 further comprises a rod 110 that is defined by a proximal end 112 and a distal end 114. The proximal end 112 of the rod 110 operatively connects to the motor 108, so that the rotational movements are imparted thereupon. The rod 110 is operable to rotate in conjunction with the power provided by the motor 108, so as to create a controllable rotation. FIGS. 4A, 4B, and 4C illustrate the rod 110 rotating in a clockwise direction. The different vantage views of the handle 102 are also shown. Suitable materials for the rod 110 may include, without limitation, aluminum, steel, metal alloys, a rigid polymer, wood, and rubber.

In one embodiment, a hook 116 joins with the distal end 114 of the rod 110. The hook 116 detachably couples to a mechanical crank or a handle of an awning. In one embodiment, the hook 116 is a partially closed or ring with a gap to enable coupling awning crank handle. Though other possible configurations of the hook 116, as used for coupling may be used.

In some embodiments, the device 100 further comprises a control portion 118 operatively connected to the motor 108. The control portion 118 is operable to perform at least one of the following: actuate the motor 108, increase the power of the motor 108, decrease the power of the motor 108, and power off the motor 108. In this manner, the control portion 118 enables at least partially controls the speed of rotation, direction of rotation, and duration of rotation by the rod 110.

As shown in FIG. 4A, the control portion 118 comprises a power on switch 126 to power on the motor 108. The control portion 118 further comprises a power off switch 128 to power off the motor 108. The control portion 118 further comprises a pause switch 130 to temporarily pause the power of the motor 108 for a controlled or a predetermined duration. The control portion 118 further comprises a directional switch 134 to control the direction of the rod 110, either clockwise or counter clockwise. The control portion 118 further comprises a speed switch 132 to adjust amount of power available to the motor 108, so as to control the rotations per minute (or second) by the rod 110. The switches 126, 128, 130, 132, 134 may be operable through depressing, sliding, pulling, or any other engagement means known in the art of switches.

In some embodiments, the control portion 118 may be coupled to the motor 108 wirelessly or through a wire. Examples include an infrared remote control, an on/off-switch, or a radio frequency remote control. Those skilled in the art will recognize that the hardware of the control portion 118 must be made suitable for the type of motor and awning manipulation to be applied.

In some embodiments, the device 100 further comprises a counter 138 operatively connected to the motor 108, or the rod 110, or both 108, 110. The counter 138 is operable to count the number of rotations by the rod 110. In this manner, the counter 138 at least partially controls the speed of rotation and duration of rotation by the rod 110 dependent on a predetermined number of rotations by the rod 110.

The counter 138 is programmed to adjust the number, speed, and duration of rotations after a predetermined number of rotations by the rod 110. The counter 138 is configured to maintain a rotational speed within "x" number of rotations, and then to slow or increase the rotational speed after "x+y" number of rotations. This variable rotational control helps to prevent damage to the awning due to high-speed revolution. Thus, the counter 138 operates to count the number of rotations by the rod 110, and then adjustably control the speed, direction, and duration of the rotations by the rod 110, based on the positional requirements of the awning.

For example, without limitation, the motor 108 is powered to full speed to rotate the rod 110 at the greatest number of rotations per second. This can be useful for extending a canopy up to 5 feet extension. However, when it is desired to extend the canopy between 5 to 7 feet, the motor 108 is powered to one-third power. Further, when it is desired to extend the canopy more than 8 feet, the motor 108 is powered to rotate the rod 110 at half power.

Though these variables in rotational speed may be adapted to compensate for different canopy materials, wind speed, and the size and shape of the awning and structure to which the awning is attached. In any case the counter 138 counts the number of rotations by the rod 110, and then adjustably control the speed of the rotations by the rod 110.

In some embodiments, the counter 138 requires processing capacity. Microcontrollers are known which can be made suitable for processing counting signals by placing one or more conversion circuits in front of the microcontroller. When for instance a microcontroller suitable for processing the number of rotations by the rod 110 must be modified for the purpose of processing signals, in this type of known microcontroller a hardware component may be added to the microcontroller.

In one embodiment, the device 100 comprises a reset switch 140 that is operatively connected to the control portion, or the counter, or both. The reset switch 140 is operable to override the count by the counter. Additionally, the reset switch 140 is configured to power off, or slow down the motor. In this manner, the reset switch 140 is operable to return the rod 110 and motor 108 to a default setting of rotation speed, and also erase the rotation memory from the counter. This reset feature can be useful when using the device 100 on different awnings that require more or less rotational speed to expand and retract.

In some embodiments, the device 100 further comprises a source of electrical power for the motor 108, such as a battery 120. The battery 120 may include a rechargeable battery 120. In another embodiment, the device 100 utilizes a power cord 122 that operatively connects to the motor 108 and to an external power source 124, such as an AC or DC source of power. The external power source may include a simple power outlet on the side of a building. However in other embodiments, alternative sources of electrical power known in the art may also be used to transmit electrical power to the motor 108.

In operation, a user can grab the handle 102 in a firm position with the thumb over the control portion 118. The user manipulates the rod 110 until the hook 116 engages and couples a mechanical crankshaft handle from the awning. From this position, the user can power on the motor 108 by pressing the power switch. Conversely the user can power off the motor 108, or pause the motor 108 by depressing the power off switch or the pause switch. The user can increase the speed of rotation by the rod 110 by manipulating the speed switch. The user may also direct the rod 110 to rotate clockwise or counter clockwise, so as to extend or retract canopy from the awning, respectively.

The awning canopy and rolling bars can unfold for guidance of the canopy to extend and retract. The movement accompanies a movement for deployment or retraction of the canopy. The canopy is capable of being rolled around a roll bar set in motion by the motor 108 and directly controlled by rotation of the rod 110.

In another embodiment, the user can choose to further automate the device 100 by allowing the counter 138 to dictate the speed of rotation. The user can program a predetermined number of rotations into the counter 138, so that the counter 138 uses or decreases the speed of rotation after the predetermined number of rotations has been achieved. In one possible embodiment, a conversion switch allows the user to actuate or ignore the counter 138. In any case, both the control portion 118 and the counter 138 are used to regulate the variable speeds, rotational directions, and durations of rotation by the rod 110.

In some embodiments, the device 100 can be customized so that the counter 138 memorizes the number of rotations, and the speed of rotations. In this manner, the same rotational speed and rotations can be used multiple times for the same awning. This unique memorization feature enables customization of how many turns the rod 110 and handle 102 can rotate. Furthermore, the memorization feature logs, or archives, the number of turns into memory. In one alternative embodiment, a digital screen may be used to display the recorded rotation count and rotational speed.

Figure 6:
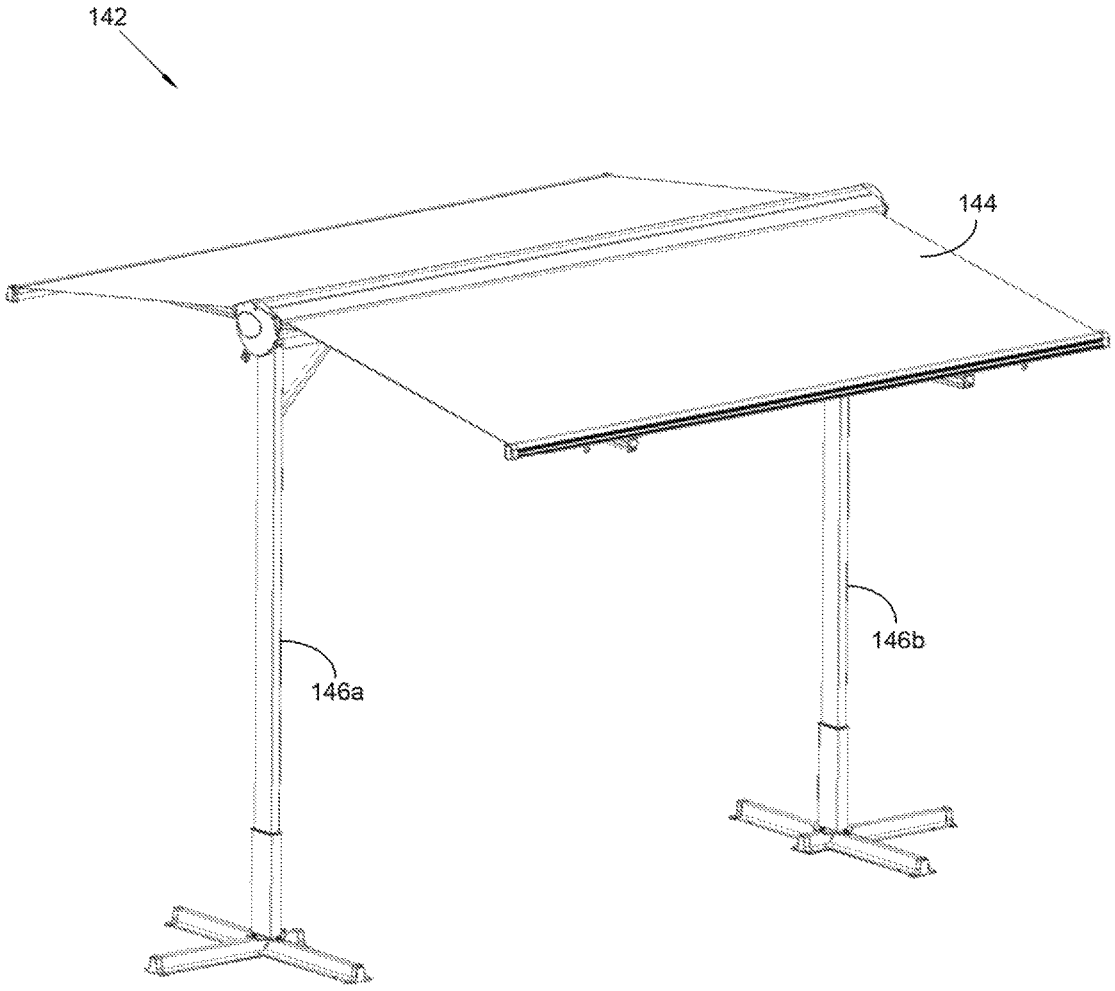
FIG. 6 illustrates a perspective view of an exemplary a free standing awning having two standing, length adjustable poles anchored into the ground, in accordance with an embodiment of the present invention.

It is significant to note that the device is operational with myriad types of awnings, canopies, and the like. In one embodiment shown in FIG. 6, the device 100 is operational to expand and retract a wall mounted awning, a free standing awnings, a roof mounted awning, and a recreational vehicle mounted awning. For example, a free standing awning 142 having two standing, length adjustable poles 146*a*, 146*b* anchored into the ground, such as shown in FIG. 6, is easily attachable and operable with the device 100. A canopy portion 144 of the free standing awning 142 is expanded and retracted by the device 100, as described above, to a desired configuration.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. An awning adjustment device with variable speed and direction control, the device comprising:

a handle defined by a sidewall forming a cavity;

a motor contained in the cavity of the handle, the motor producing variable power for performing rotational functions;

a rod defined by a proximal end and a distal end, the proximal end operatively connected to the motor, the rod operable to rotate in conjunction with the power provided by the motor;

a hook joined with the distal end of the rod;

a control portion operatively connected to the motor, the control portion operable to perform at least one of the following: actuate the motor, increase the power of the motor, decrease the power of the motor, and power off the motor, whereby the control portion enables at least partial control of the speed of rotation by the rod, whereby the control portion enables at least partial control of the direction of rotation by the rod;

whereby the control portion enables at least partial control of the duration of rotation by the rod;

a counter operatively connected to the motor, or the rod, or both, the counter operable to count the number of rotations by the rod, whereby the counter enables at least partial control of the speed of rotation by the rod, whereby the counter enables at least partial control of the direction of rotation by the rod, whereby the counter enables at least partial control of the duration of rotation by the rod; and a reset switch operatively connected to the control portion, or the counter, or both, the reset switch operable to override the count by the counter, the reset switch further configured to power off the motor.

2. The device of claim 1, further comprising a handle extension portion disposed axially to the handle.

3. The device of claim 1, further comprising a battery operatively connected to the motor.

4. The device of claim 3, wherein the battery is a rechargeable battery.

5. The device of claim 4, wherein the battery generates electrical power for the motor.

6. The device of claim 1, further comprising a power cord.

7. The device of claim 6, wherein the power cord operatively connects to the motor and to an external power source.

8. The device of claim 1, wherein the control portion comprises a power on switch.

9. The device of claim 8, wherein the control portion comprises a power off switch.

10. The device of claim 9, wherein the control portion comprises a pause switch.

11. The device of claim 10, wherein the control portion comprises a directional switch.

12. The device of claim 11, wherein the control portion comprises a speed switch.

13. The device of claim 1, wherein the rod rotates clockwise and counterclockwise.

14. The device of claim 1, wherein the hook is an open hook.

15. The device of claim 1, wherein the hook detachably couples to a mechanical crank or a handle of an awning.

16. The device of claim 15, wherein the awning comprises a canopy, a supporting framework, and a rolling bar.

17. The device of claim 1, wherein the device is an electrical hand crank.

18. An awning adjustment device with variable speed and direction control, the device comprising:

a handle defined by a sidewall forming a cavity, the sidewall comprising a grip;

a handle extension portion disposed axially to the handle;

a motor contained in the cavity of the handle, the motor producing variable power for performing rotational functions;

a rod defined by a proximal end and a distal end, the proximal end operatively connected to the motor, the rod operable to rotate in conjunction with the power provided by the motor;

a hook joined with the distal end of the rod;

a control portion operatively connected to the motor, the control portion operable to perform at least one of the following: actuate the motor, increase the power of the motor, decrease the power of the motor, and power off the motor, the control portion comprising a power on switch, a power off switch, a pause switch, a directional switch, and a speed switch, whereby the control portion enables at least partial control of the speed of rotation by the rod, whereby the control portion enables at least partial control of the direction of rotation by the rod, whereby the control portion enables at least partial control of the duration of rotation by the rod;

a counter operatively connected to the motor, or the rod, or both, the counter operable to count the number of rotations by the rod, whereby the counter enables at least partial control of the speed of rotation by the rod, whereby the counter enables at least partial control of the direction of rotation by the rod, whereby the counter enables at least partial control of the duration of rotation by the rod;

a battery operatively connected to the motor, the battery generating electrical power for the motor; and a power cord operatively connected to the motor and to an external power source, the power cord providing electrical power for the motor.

19. The device of claim 18, further comprising a reset switch operatively connected to the control portion, or the counter, or both, the reset switch operable to override the count by the counter, the reset switch further configured to power off the motor.

20. An awning adjustment device with variable speed and direction control, the device consisting of:

a handle defined by a sidewall forming a cavity, the sidewall comprising a grip;

a handle extension portion disposed axially to the handle;

a motor contained in the cavity of the handle, the motor producing variable power for performing rotational functions;

a rod defined by a proximal end and a distal end, the proximal end operatively connected to the motor, the rod operable to rotate in conjunction with the power provided by the motor;

a hook joined with the distal end of the rod;

a control portion operatively connected to the motor, the control portion operable to perform at least one of the following: actuate the motor, increase the power of the motor, decrease the power of the motor, and power off the motor, the control portion including at least one of the following: a power on switch, a power off switch, a pause switch, a speed switch, and a directional switch, whereby the control portion enables at least partial control of the speed of rotation by the rod, whereby the control portion enables at least partial control of the direction of rotation by the rod, whereby the control portion enables at least partial control of the duration of rotation by the rod;

a counter operatively connected to the motor, or the rod, or both, the counter operable to count the number of rotations by the rod, whereby the counter enables at least partial control of the speed of rotation by the rod, whereby the counter enables at least partial control of the direction of rotation by the rod, whereby the counter enables at least partial control of the duration of rotation by the rod;

a battery operatively connected to the motor, the battery generating electrical power for the motor;

a power cord operatively connected to the motor and to an external power source, the power cord providing electrical power for the motor; and a reset switch operatively connected to the control portion, or the counter, or both, the reset switch operable to override the count by the counter, the reset switch further configured to power off the motor.

* * * * *